United States Patent [19]

Parisi

[11] 4,433,451

[45] Feb. 28, 1984

[54] DEVICE FOR CLEANING SURFACES

[75] Inventor: Sebastiano Parisi, Rome, Italy

[73] Assignee: NOVUM - Novita in Elettrodomestica Srl, Trieste, Italy

[21] Appl. No.: 222,261

[22] Filed: Jan. 2, 1981

[30] Foreign Application Priority Data

Jan. 14, 1980 [IT] Italy ..... 83306 A/80

[51] Int. Cl.[3] ..... A47L 11/30

[52] U.S. Cl. ..... 15/321; 15/51; 15/322

[58] Field of Search ..... 15/320, 321, 51, 322

[56] References Cited

U.S. PATENT DOCUMENTS

| | | | |
|---|---|---|---|
| 1,296,868 | 3/1919 | Smith | 15/320 X |
| 1,827,905 | 10/1931 | Picker | 15/51 X |
| 1,884,387 | 10/1932 | Thorne | 15/51 X |
| 2,043,878 | 6/1936 | Babbs | 15/51 |
| 3,262,146 | 9/1964 | Hays | 15/321 |
| 4,019,218 | 4/1977 | Cyphert | 15/321 |
| 4,096,601 | 6/1978 | Knestele | 15/320 |

FOREIGN PATENT DOCUMENTS

| | | | |
|---|---|---|---|
| 472881 | 7/1969 | Switzerland | 15/320 |

*Primary Examiner*—Chris K. Moore

*Attorney, Agent, or Firm*—Stevens, Davis, Miller & Mosher

[57] ABSTRACT

A device for cleaning surfaces using steam as dirt soaking element and dirt detergent element, whereby extraction components, suction components and steam generating components are available, comprising:

a cleaning head with suction components, moisturizing components, brushing components and absorption and cleaning components interacting with spraying components and a basic unit comprising suction fans, steam generating unit and control elements.

8 Claims, 7 Drawing Figures

DEVICE FOR CLEANING SURFACES

The present invention relates to a device for cleaning surfaces which is not subject to heavy duty usage.

More specifically, it relates to a device suitable for cleaning surfaces with brushing and cleaning heads supplied with dirt suction elements which beneficially are provided with detergent components using steam.

Appliances and devices to clean floors and walls are already known.

Some appliances clean the floor using additional suction fans with rotating brushes suitable for removing the dirt.

Other devices spray detergent substances with a chemical effect. Others provide a flat perforated element which can be covered by a cloth and on top of this is a chamber in which steam is expanded, whereby the steam is blown through the holes and passes through the cloth before reaching the surface which is to be cleaned.

The foregoing solutions do not, however, lead to a complete and deep cleaning of the floor or the wall, and they are devised for specific and limited cleaning requirements. Thus some of them are more suitable for tiled floors, others for carpeting and others for plastic floors, etc.

The device of the present invention is suitable for thoroughly cleaning practically any type of surface with only one sweeping movement.

This device comprises suction elements, dirt soaking elements and dirt absorption elements whereby the dirt soaking and detergent substance is steam, obtained under pressure from a suitable steam generator.

One object of this invention is to provide a suction element in order to avoid a previous cleaning with a vacuum cleaner.

A further object is to provide a soaking means in order to guarantee deeper cleaning.

A further object is to provide a soaking action using steam so that the soaking action can also be transformed into a detergent action.

Furthermore, it is intended to provide elements for absorption such as cloths, which are easily replaced and preferably disposable, thus facilitating immediate disposal of soaked dirt.

In combination with the above mentioned objects, the invention also presents other advantages.

One advantage is the easy operation of the device and the use of steam which, by penetrating in depth, removes dirt completely and, at the same time, sterilizes the surrounding area; the loose dirt having been removed previously by suction.

An added advantage is that the complete cleaning operation is executed in one sweeping movement without the need for further and extra operations such as sweeping, vacuum cleaning, washing and drying.

These objects and advantages together with other objects and advantages are accomplished by a device having a cleaning head having at least at the front, a suction component accompanied by moisturizing components between which brushing components are suitably located, while absorption and cleaning components are located at the back to interact with components of a basic unit presenting suction means, steam generating and control elements The present invention will be described in more detail with respect to the embodiments shown in the accompanying drawings given by way of non-limiting example, in which equal or equivalent parts are marked by the same reference numerals and in which:

Figure 1:
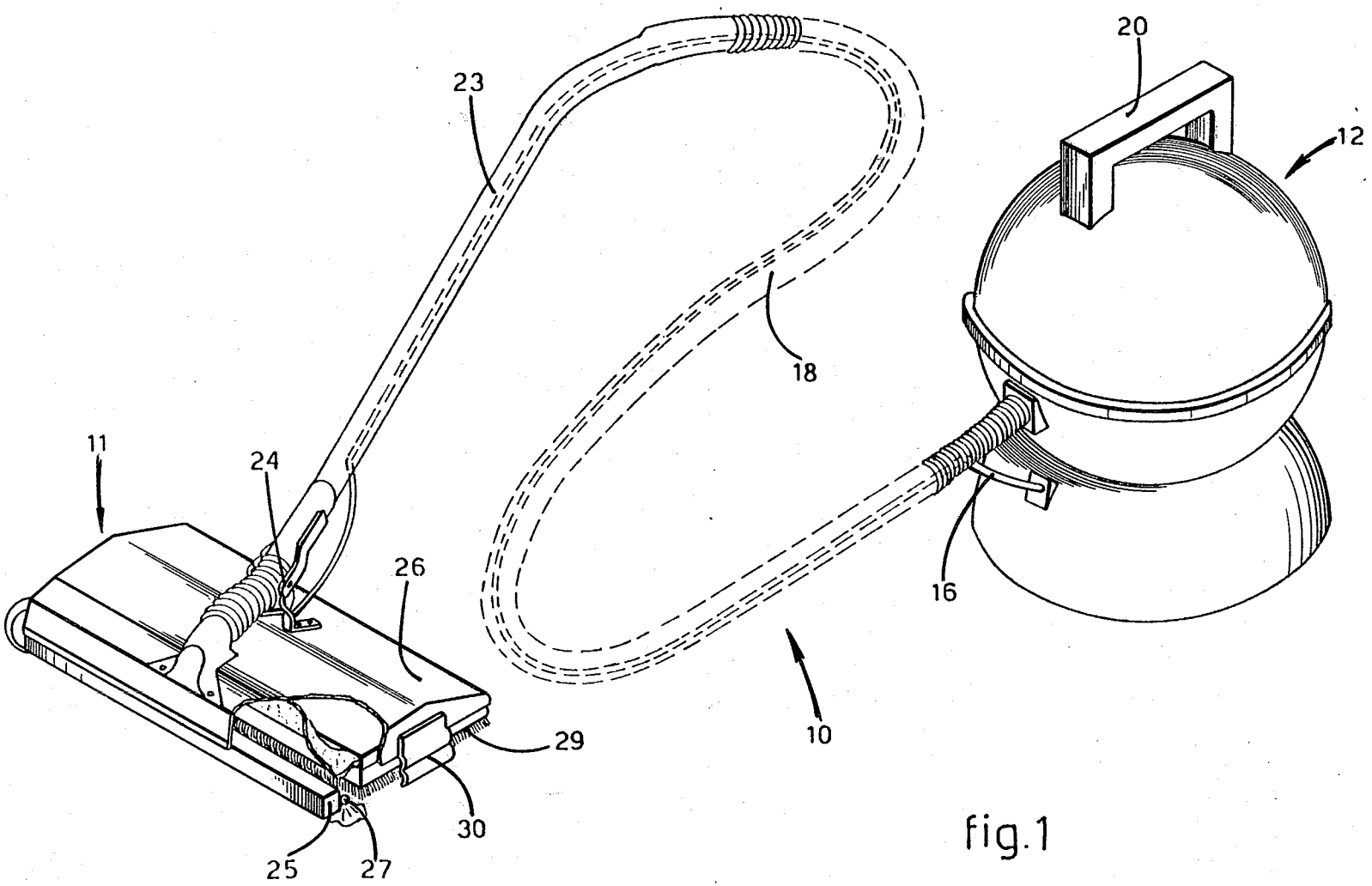
FIG. 1 shows a first embodiment of the present invention.
Figure 2:
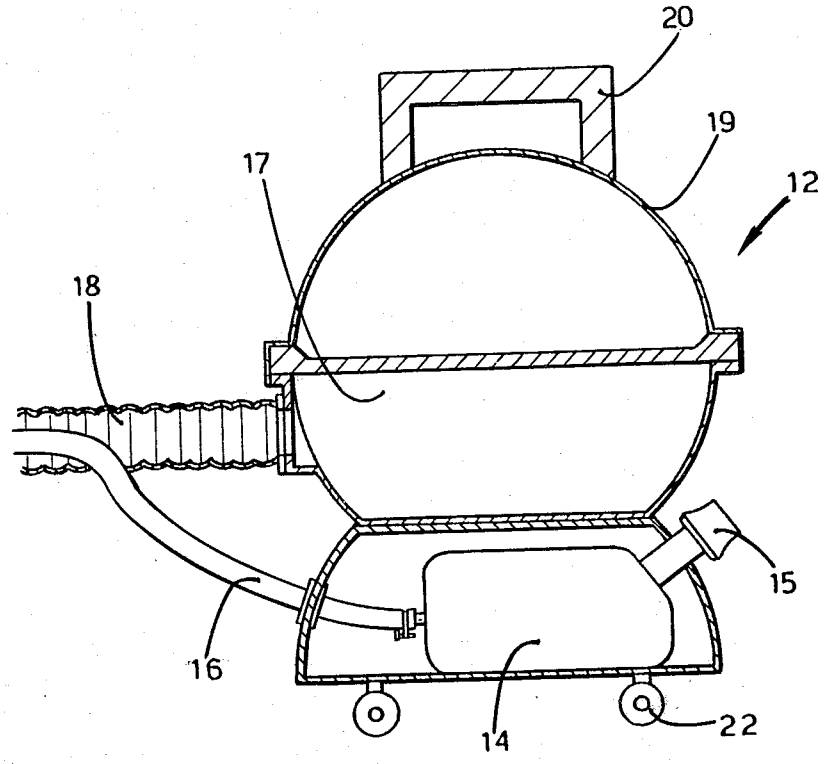
FIG. 2 shows a section of the container in FIG. 1.
Figure 3:
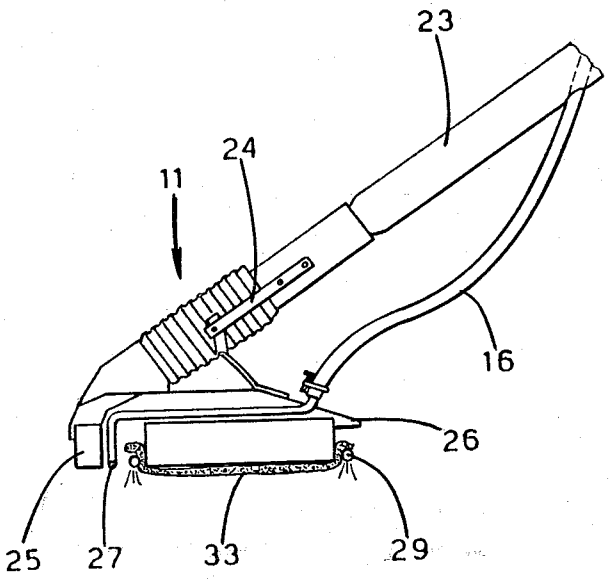
FIG. 3 shows a longitudinal section of the operating head of FIG. 1.

Referring now to FIG. 1, the device for cleaning surfaces is designated generally as 10 and has an operating or cleaning head 11 and a basic unit 12 containing in the specific case a steam generator 14 and suction fan 17 (FIG. 2).

Figure 4:
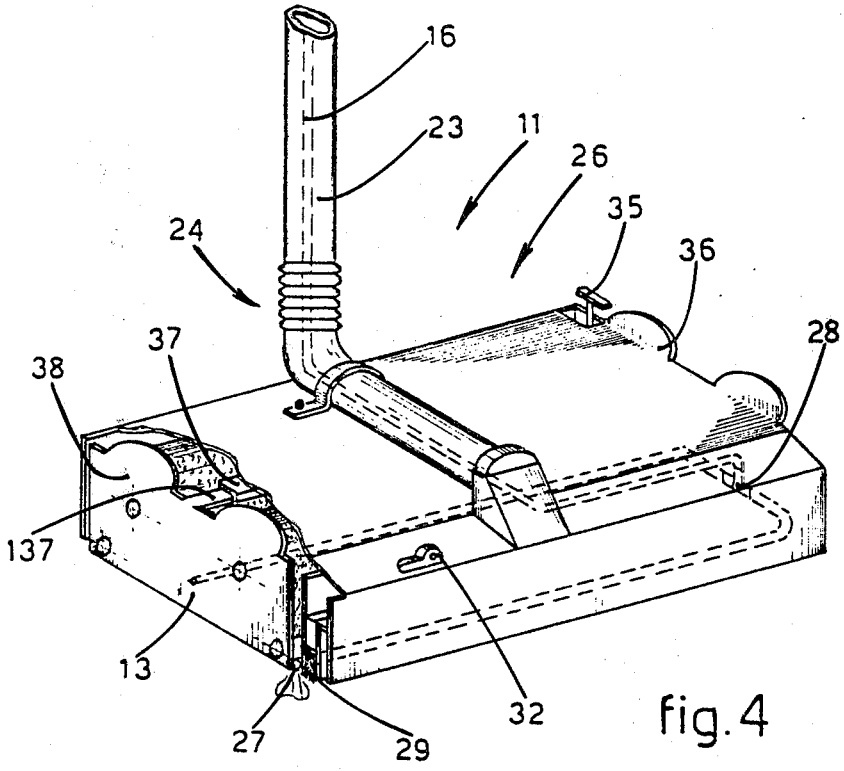
FIG. 4 shows a second embodiment of the operating head seen in a partially cut away perspective.
Figure 5:
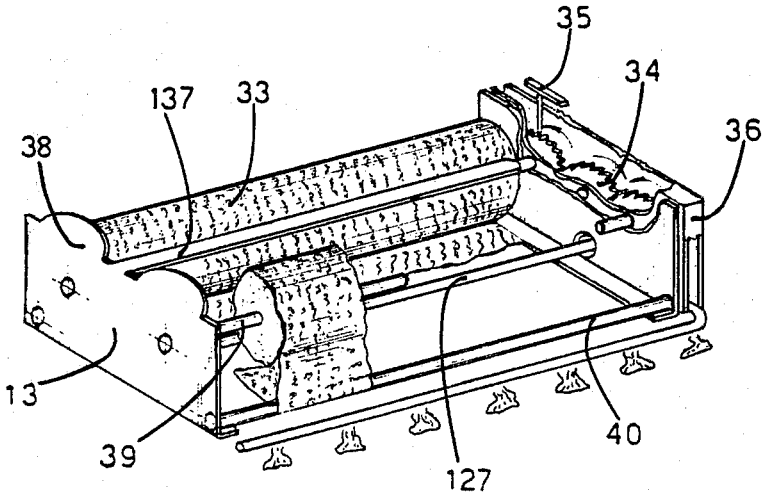
FIG. 5 shows a detail of the embodiment of FIG. 4.
Figure 7:
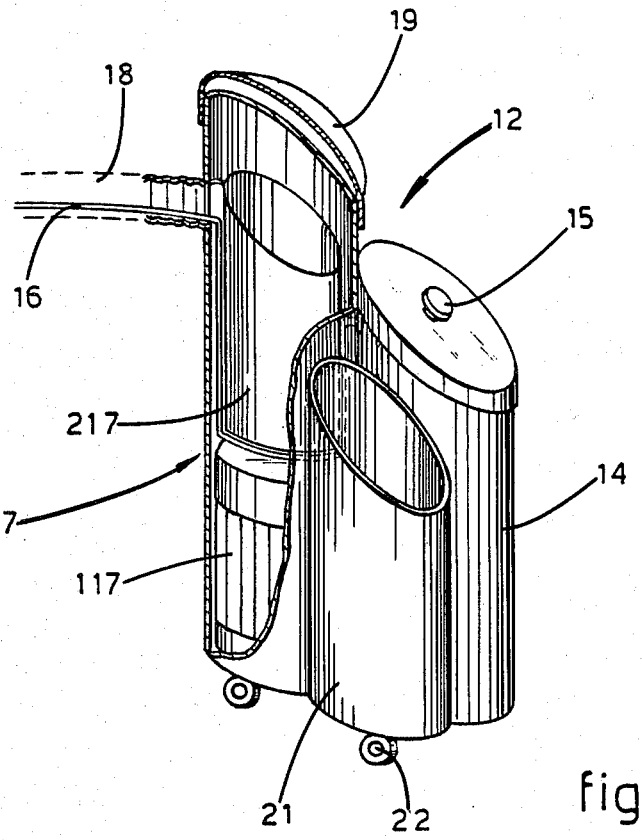
FIG. 7 shows, in perspective, a second embodiment of the basic unit of FIG. 1.
Figure 6:
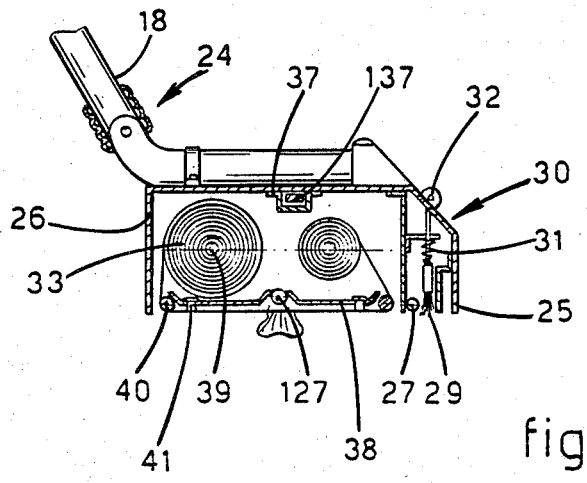
FIG. 6 shows a longitudinal section of the operating head of FIG. 4.

A component 13 (FIGS. 4 and 5) of the operating head 11 may contain a rag or cloth 33 and/or reeling-up roller 39 and returning rollers 40 according to the invention. The cloth 33 may be extractible or at least overturnable.

The steam generator 14 may be of a liquid vaporization content type or an instantaneous vaporization type. For this second type it will be necessary to provide an upper container which supplies the wanted quantity of liquid to be vaporized. The production of steam may preferably be obtained by electric heating but also may be obtained from other heat sources.

Generator 14 has a cap 15 in case it is filled with liquid.

A flexible hose 16, preferably at least in part contained in hoses 18 and 23, serves to convey the steam from the generator 14 to the operating head 11.

Vacuum cleaner 17 in basic unit 12 of an already known type contains preferably a ventilating motor 117 and a dirtcollecting bag 217 accessible from outside and a flexible hose 18 which connects vacuum cleaner 17 to the operating head 11.

An optional cap 19 fits over container 12 which allows the vacuum cleaner 17 to be entirely accessible and at the same time hides it.

The container 12 has an optional handle 20.

An optional accessory container 21 (for exchange-cloth, water can, funnel etc) is located beside element 12. Accessory container 21 may be united with 12 or be optionally added.

Container 12 has wheels 22 which permits easy relocation of the container.

An optionally solid hose 23 connects the operating head 11 to the flexible hose 18. Head 23 also functions as a handle to facilitate the movement of the head.

An optional articulation device 24 on the operating head 11 serves to facilitate movement of head 11, particularly if the movement is carried out in difficult locations.

Suction aperture 25 is interconnected to extractor 17 and is located at a short distance from the floor. Aperture 25 may be positioned elastically vertically.

Operating head 11 is supported on a chassis 26.

Steam spray hose 27, preferably consisting of a hose perforated in its lower part, is connected with the flexible hose 16 either directly or via a three-way valve 28.

Spray hose 127 similar to spray hose 27 also is connected to the flexible hose 16, optionally via the three-way valve 28. The spray hose 127 is located internally and acts on cloth 33 accomplishing the function of further softening the difficult dirt.

Optional three-way valve 28 conveys the steam from the flexible hose 16 either to spray hose 27 or to spray hose 127 or to both. This valve may be situated in any possible ergonometric valid position.

Brush elements 29 can be attached to the chassis 26, for example, by means of a mechanism 30 or with another suitable element. The brush elements 29 may be located either in front or at the back or along the entire circumference.

Mechanism 30, preferably with release, preferably has two positions which cause the blocking and the vertical positioning of brush 29.

Optional spring components 31 keep brush 29 elastically pressed down, towards the floor.

Control 32 releases mechanism 30.

Cloth 33, used for cleaning and drying up the floor, may be fixed or be fixable to the operating head 11, but it may also be sliding and/or blockable in a wanted position. Here the term cloth is used in a general meaning because it may be textile, paper, material of non woven fabric etc.

Advancement of cloth 33 is provided by mechanism 34 which can be controlled from outside by lever 35.

Chassis 26 has a lateral wall 36.

The optional guidance device of component 13 is defined by 37 and 137.

Profiled piece 38 of component 13 facilitates its removal.

Roller 39 on which cloth 33 is coiled is removable from the advancement mechanism 34 which is hinged on wall 36. Rod 40 deflects cloth 33 in passing between rollers.

Elastic compression element 41 forces the cloth towards the floor.

Looking now to the function of the device the appliance is taken by hand to the surface to be cleaned using handle 20 or sliding the basic unit 12 on the wheels 22.

The steam generator 14 through cap 15 is filled and steam production awaited.

If a tiled floor is to be cleaned, a cloth 33 of suitable dimensions is placed on the lower part of the chassis 26. This cloth is attached to the chassis 26 together with the brush 29 by a mechanism 30. In one embodiment the brush 29 surrounds cloth 33 and as an advantage it sticks out in comparison with cloth 33.

The motor of the vacuum cleaner 17 is then switched on and the appliance is ready for use.

The surface to be cleaned is first under the action of vacuum cleaner 17 and subsequently under that of spray hose 27 and brush 29.

The combined effect of the steam streaming from the spray hose 27 and brush 29 removes completely the dirt. Particularly, the steam exercises on the dirt a soaking effect and the dirt is definitely removed from the bristles of brush 29 by forcing the operating head 11 into a to-and-fro movement.

Cloth 33 collects dirt and partially dries the floor.

Cloth 33 must from time to time be replaced by similarly clean and dry material.

If it is desired to clean a carpeted surface, brush 29 is shifted via mechanism 30 so that it does not protrude beyond cloth 33.

In this case the function of the device is analogous with the one previously described; the only difference being in the fact that there is no longer the action of brush 29.

The dust is removed by the vacuum cleaner 17. Subsequently the steam removes the dirt taking it to the surface where it is collected and absorbed by cloth 33.

Looking now to the function of the different embodiments, the starting procedure is quite similar to that above described.

If a marble floor is to be cleaned valve 28 is set so that the steam arrives only at the spray hose 27. After having started the motor of the vacuum cleaner 17 and after the steam has started being produced the cleaning of the floor begins by guiding the operating head 11 by means of the solid hose 23.

The floor first undergoes the action of the vacuum cleaner 17 and then the soaking action of the steam which streams from spray hose 27.

The dirt is definitely removed by the brushes 29 and absorbed by cloth 33 which also provides for the drying of the floor.

The brush 29 which is located transversally to the operating head 11 can be attached elastically to the chassis 26 via a mechanism 30.

In this case brush 29 is positioned so that it protrudes by comparison with cloth 33 and is pushed elastically on the floor. The cloth is replaced by operating the lever 35 of mechanism 34 and it is thus coiled from one roller to the other roller 39.

If it is desired to clean a carpeted floor, valve 28 is operated so that the steam gets only to the spray hose 127.

The brush 29 is positioned by means of mechanism 30 so that it does not protrude beyond cloth 33. In that way the dust is removed from the carpeting and undergoes the action of cloth 33 moistened by the steam coming from the spray hose 127.

The effect is that the dirt is brought to the surface, and cloth 33, moistened by steam, finally provides the collection of the previously removed dirt by a to-and-fro movement. Also in this case cloth 33 is renewed from time to time by operating lever 35 of mechanism 34. It is interesting to note that the replacement of cloth 33 is easily feasible by removing or tilting component 13. In this way the rollers 39 are released automatically from mechanism 34.

The foregoing give preferential realizations of the invention, but other variants are possible.

It is possible to modify form, rates and dimensions. Furthermore it is possible to perform the described realizations by inversion of the operations of washing and absorption. It is possible to shift the position of the spray hoses 27 and 127 or to provide means of positioning cloth 33 that are suitable for the facilitation of its assembling. It is possible to determine working units and operating heads for different preferential realizations.

These and other variants are possible by a technician skilled in the art without going beyond the scope of this invention.

I claim:

1. A device for cleaning surfaces comprising a cleaning head having a front and back composed of means to suck up material from said surfaces, means to moisten said surfaces, means to brush said surfaces, and means to absorb dust and wipe clean said surfaces positioned between said moistening means and said surfaces and interacting with said moistening means; a basic unit composed of a suction fan, steam generator and means to control said suction and moistening means and means interconnecting said cleaning head and basic unit.

2. The device of claim 1, wherein said basic unit includes first and second walled compartments, said steam generator being housed in said first compartment, a first hose attached to said steam generator and extending through the wall of said first compartment to said cleaning head, said suction fan being housed in said second compartment, a second hose communicating with said fan through the wall of said second compartment and extending to said cleaning head, wheel elements attached to said first compartment and a handle element attached to said second compartment.

3. The device of claim 2, wherein said steam generator comprises means to hold water and means to heat said water.

4. The device of claim 2, wherein said steam generator comprises a container of vaporizable liquid and means to heat said liquid.

5. The device of claim 1 including means to regulate the height of said brush means and wherein said suction means are positioned at the front of said cleaning head and extending across thereof, said brush means and moistening means are positioned behind said suction means and said absorption and wiping means comprise a replaceable cloth.

6. The device of claim 5 wherein said moistening means comprise a first spray hose for spraying steam directly on the surface to be cleaned and a second spray hose for spraying steam directly on said cloth and a valve for distributing steam to said hoses.

7. The device of claim 5 wherein said absorbing and wiping means comprise two rollers about which the replaceable cloth is wound and means to rotate said rollers to advance said cloth from one roller to the other.

8. The device of claim 5 wherein said second spray hose is directed toward the surface to be cleaned.

* * * * *